United States Patent [19]

Knox et al.

[11] 4,420,147

[45] Dec. 13, 1983

[54] WEB FOLDING AND SEALING MACHINE

[75] Inventors: William J. Knox; Byron C. Hall, both of Dayton, Ohio

[73] Assignee: The Standard Register Company, Dayton, Ohio

[21] Appl. No.: 396,797

[22] Filed: Jul. 9, 1982

Related U.S. Application Data

[63] Continuation-in-part of Ser. No. 329,756, Dec. 11, 1981.

[51] Int. Cl.[3] ..... B41L 43/12; B31B 23/00

[52] U.S. Cl. ..... 270/37; 493/131; 493/141; 493/335; 493/393; 156/495

[58] Field of Search ..... 270/37, 53; 493/131, 493/141, 132, 190–191, 265, 274, 332, 335, 393; 156/495, 494, 583

[56] References Cited

U.S. PATENT DOCUMENTS

| | | | |
|---|---|---|---|
| 3,130,647 | 4/1964 | Anderson | 493/191 |
| 3,709,775 | 1/1973 | James | 156/308.4 X |
| 4,050,361 | 9/1977 | Traise | 493/332 |

*Primary Examiner*—A. J. Heinz

*Attorney, Agent, or Firm*—Jacox & Meckstroth

[57] ABSTRACT

A machine for folding and gluing a continuous web in high speed operation. A continuous web which has solidified glue thereon in selected regions is folded. Heat is applied to the folded web to melt the glue, particularly in specific areas of the folded web. Pressure is applied to the specific areas to urge together the folded portions of the web and the melted glue therebetween. Then the folded web travels between heat transfer members which rapidly cool the folded web and the glue between folded portions thereof. Thus, the glue is solidified and the folded portions are firmly adhesively attached together.

4 Claims, 5 Drawing Figures

WEB FOLDING AND SEALING MACHINE

RELATED APPLICATION

This application is a continuation-in-part of application Ser. No. 329,756, filed Dec. 11, 1981.

BACKGROUND OF THE INVENTION

Machines are in use which fold a continuous web and which also glue the folded portions of the web together as the web travels through the machine. Customarily, such machines receive a continuous flat web. The web may be of a single ply or may be of multiple plies. The web carries glue of the hot melt type. The glue is carried on several areas of the web and is in a solid state. The web is first folded in the machine. Then the web travels to a portion of the machine at which heat is applied to the folded web to melt the glue. The folded web then continues in its travel through the machine and is permitted to cool to again solidify the glue to attach together the folded portions of the web.

It has been found that known machines of this type have not been capable of folding and sealing a web at sufficiently high rates of speed to accommodate printing machines which operate at a high rate of speed.

It is therefore an object of this invention to provide a machine for folding and gluing a continuous web and which is capable of operation at a higher rate than is possible with known machines.

Other objects and advantages of this invention reside in the construction of parts, the combination thereof, the method of production and the mode of operation, as will become more apparent from the following description.

DETAILED DESCRIPTION OF THE INVENTION

A web folding and sealing machine of this invention comprises a web receiver platform 14, having guide members 16, which are laterally adjustable between pedestals 18. The web receiver platform 14 and the pedestals 18 are supported by support structure 20.

Figures 1, 2:
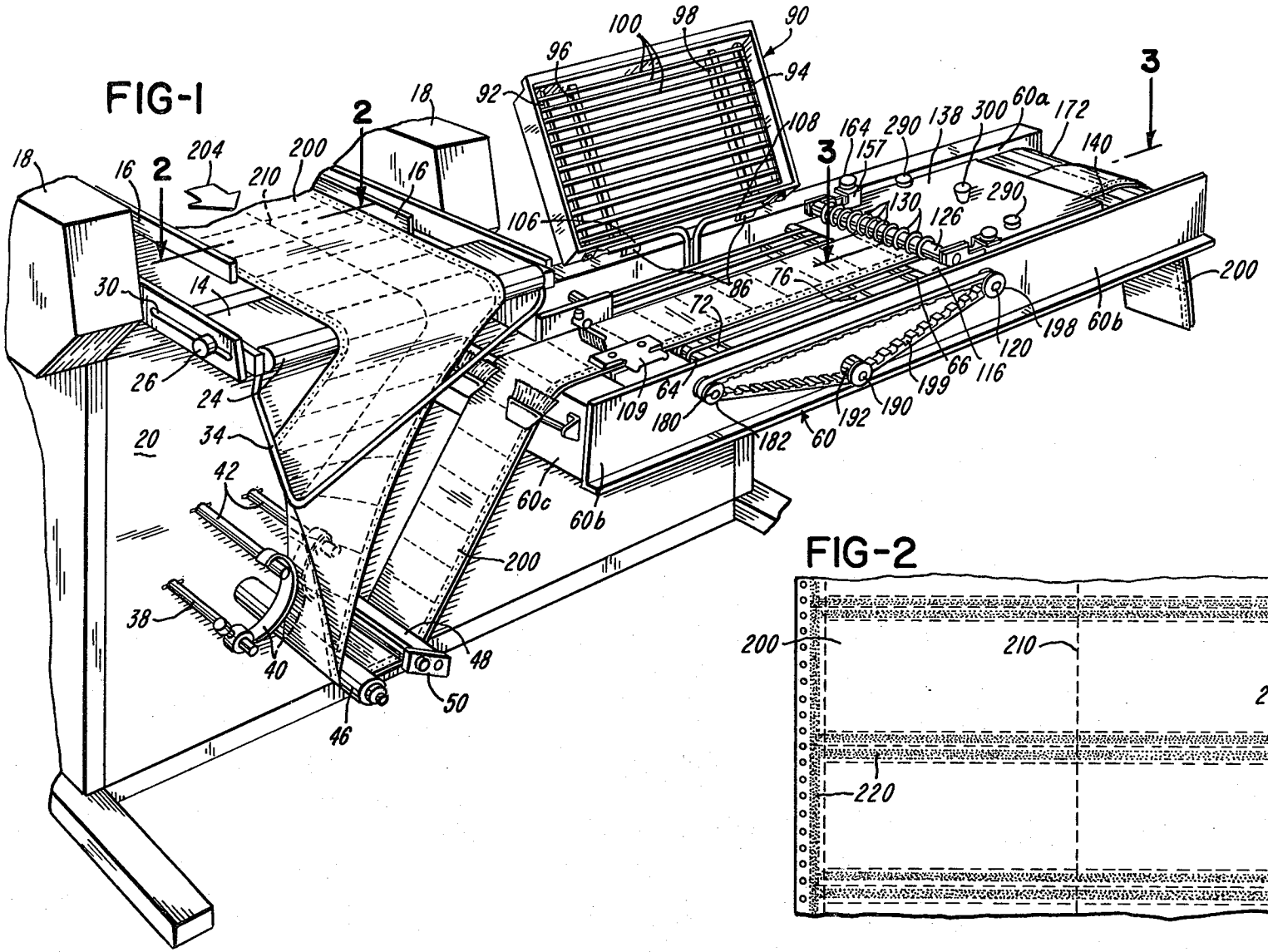
FIG. 1 is a perspective view, with parts broken away, of a web folding and sealing machine of this invention.
FIG. 2 is an enlarged plan view, taken substantially on line 2—2 of FIG. 1.

The web receiver platform 14 has rotatably attached thereto a roller 24 which is laterally adjustable toward and away from the pedestals 18 by means of adjustment members 26 which are movable within elongate slots 30, one of which is shown in FIG. 1.

Supported by the web receiver platform 14 and extending therebelow is a generally V-shaped rod 34. Attached to the support structure 20 at a lower level than the V-shaped rod 34, the stems 38 which support curved resilient pressure members 40. Stems 42 adjacent the pressure members 40 are engageable by the pressure members 40 to control the action thereof.

Supported by the support structure 20, at a lower level than the stems 38 and 42, is a roller 46. Adjacent the roller 46 is a roller 48 which is mounted upon a bracket 50 which is supported by the support structure 20 and which is pivotally movable and which permits lateral movement of the roller 48.

Figure 3:
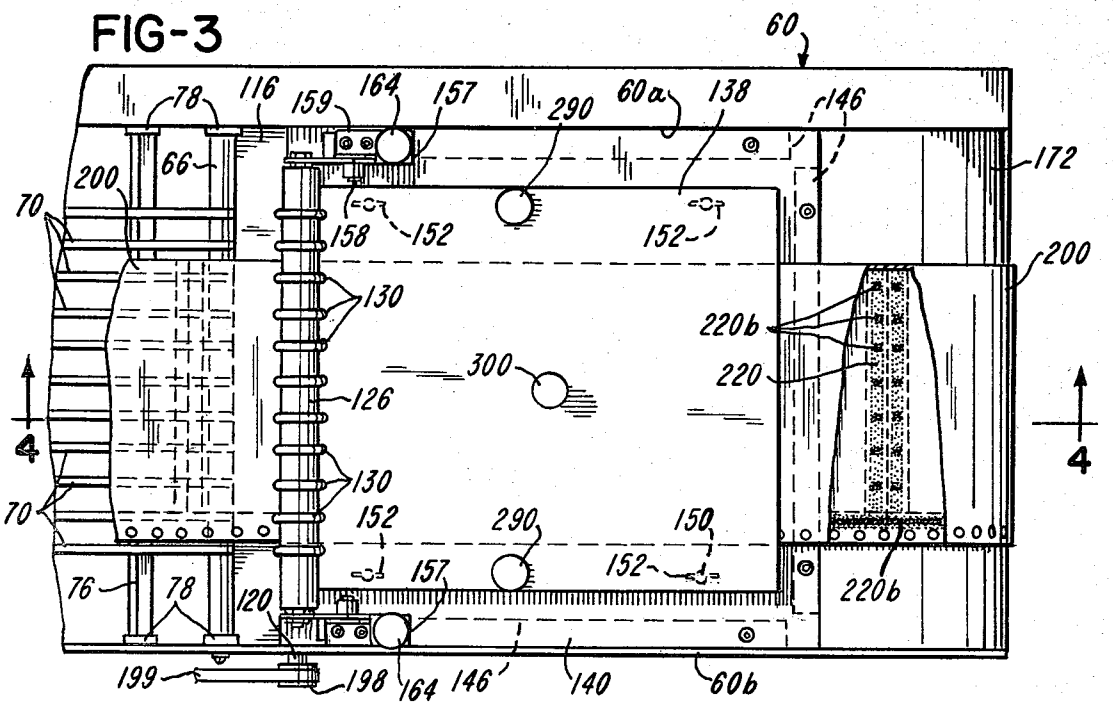
FIG. 3 is an enlarged plan view, with parts broken away, taken substantially on line 3—3 of FIG. 1.

The support structure 20 also supports an elongate frame 60, having side frame members 60*a* and 60*b*, and an end frame member 60*c*. The side frame members 60*a* and 60*b* support spaced-apart electric conductor rods 64 and 66, which are electrically insulated from the side frame members 60*a* and 60*b*, as illustrated in FIGS. 1 and 3. A plurality of parallel electrically conductive heater strips 70 extend along the frame 60. The heater strips 70 have one end thereof attached to a connector bar 72, which is attached to the side frame members 60*a* and 60*b*. The electrically conductive heater strips 70 extend from the connector bar 72, a round a portion of the electric conductor rod 64 and around a portion of the conductor rod 66, and the opposite ends of the heater strips 70 are attached to spring members 74, which are attached to a connector bar 76, which is supported by the side frame members 60*a* and 60*b*. The connector bars 72 and 76 are electrically insulated by insulation members 78 from the side frame members 60*a* and 60*b*.

The heater strips 70 are adjustably laterally movable along the conductor rods 64 and 66 and along the connector bars 72 and 76. Thus, the spacing between individual heater strips 70 can be adjusted. Suitable electrical conductors, not shown, are connected to the electric conductor rods 64 and 66 for energization thereof.

Hingedly attached to the side frame member 60*a* by means of hinges 86, adjacent the electric conductor rods 64 and 66, is a cover member 90, as best illustrated in FIG. 1. Within the cover member 90 and attached thereto are electric conductor rods 92 and 94, which are electrically insulated by insulation members 78 from the cover member 90. Also within the cover member 90 and attached thereto are connector bars 96 and 98 which are electrically insulated from the cover member 90. A plurality of parallel electrically conductive heater strips 100 are within the cover member 90. One end of the heater strips 100 is attached to the connector bar 96. The heater strips 100 extend around a portion of the electric conductor rod 94. The other end of the heater strips 100 is attached to spring members 102 which are attached to the connector bar 98.

The heater strips 100 are adjustably laterally movable along the conductor rods 92 and 94 and along the connector bars 96 and 98. Thus, the spacing between individual heater strips 100 can be adjusted. An electric cable 106 is attached to the electric conductor rod 92, and an electric cable 108 is attached to the electric conductor rod 94, as shown in FIG. 1.

Figure 4:
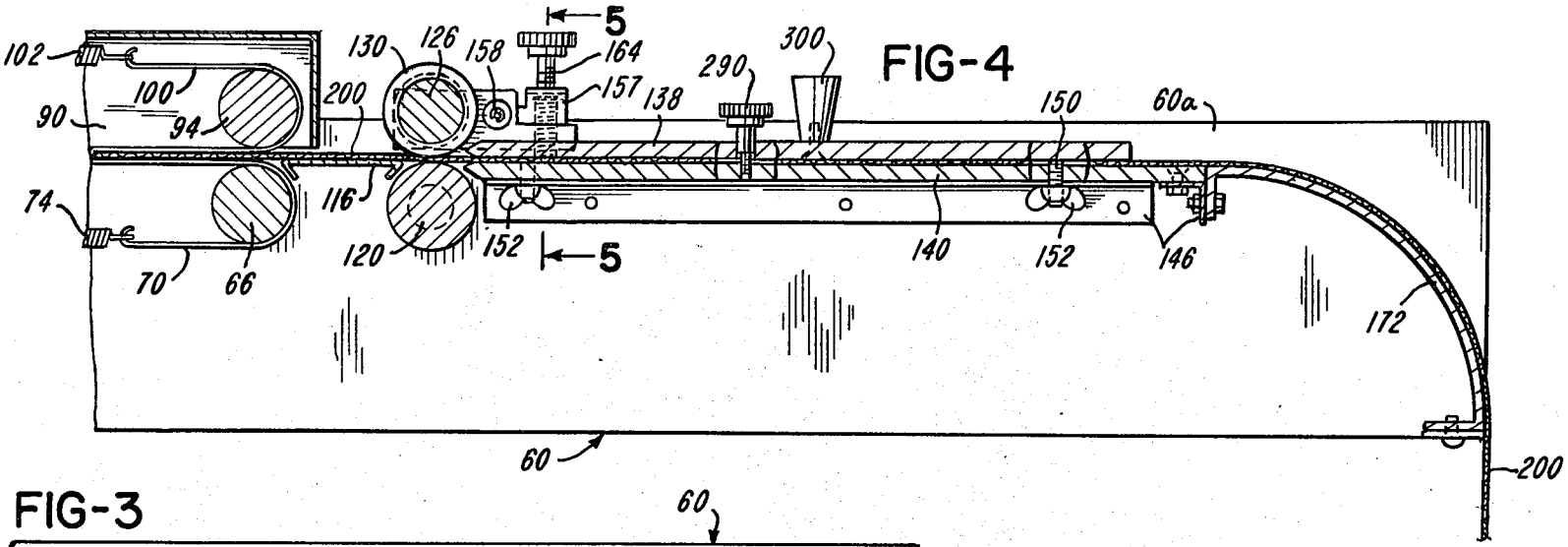
FIG. 4 is an enlarged sectional view, taken substantially on line 4—4 of FIG. 3.

FIG. 1 shows the cover member 90 in an open position. FIG. 4 illustrates the cover member 90 in closed position. When the cover member 90 is in closed position as shown in FIG. 4, each of the heater strips 100 is directly above one of the heater strips 70 and in close relationship thereto along the length thereof. Also, supported by the frame 60 is a web drive unit 109, shown in FIG. 1.

Supported by the frame members 60*a* and 60*b* and extending therebetween adjacent the conductor rods 66 and 94 is a support plate 116, which is also adjacent a drive shaft 120. Immediately above the drive shaft 120 and parallel thereto is a follower shaft 126. Tightly emcompassing the follower shaft 126 are elastomeric rings 130. Each of the elastomeric rings 130 is in alignment with one of the heater strips 100 and with one of the heater strips 70.

Adjacent the follower shaft 126 and extending therefrom is an upper thermal conductor plate 138. Immediately below the upper thermal conductor plate 138 is a lower thermal conductor plate 140. Each of the thermal conductor plates 138 and 140 is preferably of a material having good thermal conductivity, such as aluminum or the like. The lower thermal conductor plate 140 is supported upon brackets 146 which are attached to the frame members 60*a* and 60*b*. As shown in FIG. 4, threadedly mounted within the lower thermal conductor plate 140 is a plurality of support screws 150, which are positioned adjacent the brackets 146. The upper thermal conductor plate 138 is thus supported upon the support screws 150 in slight spaced relationship above the lower thermal conductor plate 140. A wing nut 152 encompasses the lower portion of each of the support screws 150 for securing the position thereof.

Figure 5:
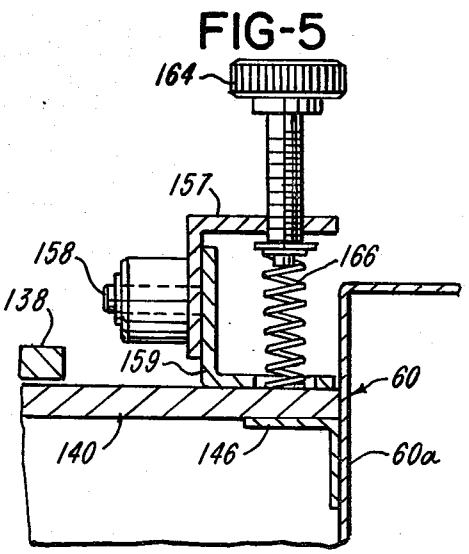
FIG. 5 is an enlarged sectional view, taken substantially on line 5—5 of FIG. 4.

As shown in FIGS. 3 and 4, the follower shaft 126 is rotatably supported upon arms 157, which are pivotally supported upon pins 158 which are carried by pedestal members 159, which are mounted upon the lower thermal conductor plate 140. An adjustment bolt 164 is threadedly attached to each of the arms 157. As best illustrated in FIG. 5, the adjustment bolt 164 engages a spring 166, which is supported upon the lower thermal conductor plate 140. Thus, adjustment of the adjustment bolt 164 adjusts the downward pressure applied by the elastomeric rings 130 of the follower shaft 126.

Attached to the lower thermal conductor plate 140 and extending therefrom is a curved extension thermal conductor plate 172, which is preferably of the same material as the thermal conductor plates 140 and 138.

Means, not shown, are connected to a drive shaft 180 for rotation thereof. The drive shaft 180 is supported by the frame 60 and has attached thereto for rotation therewith a drive wheel 182, as shown in FIG. 1. The drive shaft 180 is also connected to the web drive unit 109 in a manner not shown, for operation thereof. Rotatably supported by the side frame member 60*b* is an idler shaft 190 to which is attached a wheel 192. The drive shaft 120 extends through the side frame member 60*b* and has attached thereto a wheel 198. Encompassing the drive wheel 182, and the wheels 192 and 198 is a power drive belt 199, illustrated in FIGS. 1 and 3.

OPERATION

The left portion of FIG. 1 shows a continuous flat web 200 which moves onto the receiver platform 14 of the machine of this invention, as illustrated by an arrow 204. The web 200 has a longitudinal centrally located fold line 210, shown in FIG. 2. The flat web 200 also carries glue 220 upon predetermined portions thereof, as shown in FIG. 4. The flat web 200 may also carry printed indicia thereupon, not shown. The flat web 200 travels over the receiver platform 14 between the guide members 16, as illustrated in FIG. 1. The web 200 then travels over the roller 24 and downwardly between opposed portions of the V-shaped rod 34. As the web 200 travels between opposed portions of the V-shaped rod 34, folding of the web 200 begins. The web 200 then travels between the resilient pressure members 40, which apply pressure to the portion of the web 200 adjacent the fold line 210, and a creasing action upon the web 200 occurs. The web 200 is thus firmly folded and travels around the rollers 46 and 48. The web 200 in its folded condition then travels upwardly to the frame 60 and to the web drive unit 109. The web 200 in its folded condition is then introduced into the web drive unit 109, which moves the folded web 200 between the heater strips 70 and 100, as illustrated in FIG. 4.

Electrical energy is applied to the conductor rods 64, 66, 92, and 94 to energize the heater strips 70 and 100, which are in firm engagement therewith. At the same time, or after a short time delay, the motor means which rotates the shaft 180 and the drive wheel 182 is energized. Thus, the web 200 moves in the direction illustrated by the arrow 204 in FIG. 1. Thus, the continuous web 200 is folded, and as folding occurs, the glue 220 becomes sandwiched between the two folded portions of the web 200. Then the web 200 in the folded condition travels to the heater strips 70 and 100 and moves therebetween. The glue 220 is heated and melted by the heater strips 70 and 100. As the folded web 200 travels between the heater strips 70 and 100, the portions of the glue 220 which move directly between a lower heater strip 70 and an upper heater strip 100 are melted. However, other portions of the glue 220 which do not move directly between a lower heater strip 70 and an upper heater strip 100 may also be melted.

The folded web 200 then travels upon the support plate 116 to a position between the shafts 120 and 126. Due to the fact that each of the elastomeric rings 130 upon the follower shaft 126 is in alignment with a heater strip 70 and a heater strip 100, each of the elastomeric rings 130 applies a pressure to the upper part of the web 200 at a portion of the web 200 having melted glue 220. Thus, the glue 220 is firmly pressed upon opposed portions of the web 200, primarily at the spaced-apart portions of the folded web 200 which travel between the heater strips 70 and 100 and which also travel under the elastomeric rings 130.

The folded web 200, with the glue 220 between opposed portions thereof, then travels between the upper thermal conductor plate 138 and the lower thermal conductor plate 140. The thermal conductor plates 138 and 140 are spaced apart only a sufficient distance to permit the folded web 200 to slidably travel therebetween. Thus, the folded web 200 engages the thermal conductor plates 138 and 140, and the thermal conductor plates 138 and 140 quickly and readily remove heat from the folded web 200. Thus, the glue 220 is quickly cooled and solidified. Thus, the portions of the folded web 200 which have glue 220 applied thereto are attached together by the glue 220, and the portions of the folded web 200 are sealed together as the web 200 travels at a high rate. The glue 220 which attaches together opposed portions of the web 200 may appear in the manner illustrated by reference numeral 220*b* in FIG. 3. The folded web may comprise any desired number of plies.

As shown in FIG. 4, screws 290 extend through the upper thermal conductor plate 138 adjacent the side edges thereof and into the lower thermal conductor plate 140 to attach the upper thermal conductor plate 138 to the lower thermal conductor plate 140.

The upper thermal conductor plate 138 has a knob 300 on the upper surface thereof for lifting the upper plate 138 from the lower thermal conductor plate 140.

Although the preferred embodiment of the web folding and sealing machine of this invention has been described, it will be understood that within the purview of this invention various changes may be made in the form, details, porportion and arrangement of parts, the combination thereof, and the mode of operation, which generally stated consist in a web folding and seaing machine within the scope of the appended claims.

The invention having thus been described, the following is claimed:

1. Apparatus for sealing a continuously moving continuous folded web which carries solidified glue on selected areas of longitudinally extending regions thereof between the folded parts of the web comprising:

elongate support structure including first and second aligned sections along which the continuous folded web is movable, a plurality of pairs of elongate heater strips, there being a plurality of laterally spaced-apart elongate lower heater strips and a plurality of laterally spaced-apart elongate upper heater strips in the first section of the support structure, each upper heater strip being directly above one of the lower heater strips along the length thereof, the pairs of heater strips being substantially parallel to each other and parallel to the longitudinal axis of the elongate support structure so as to be aligned with the longitudinally extending regions, support means supporting the upper heater strips and movable with respect to the lower heater strips for movement of the upper heater strips toward and away from the lower heater strips, a pair of closely spaced parallel conterminous thermal conductor plates in the second section of the elongate support structure, a first pressure roller positioned between the first section and the second section of the elongate support structure and extending transversely across the elongate support structure, a plurality of elastomeric pressure rings tightly encompassing the first pressure roller, there being one elastomeric pressure ring in alignment with each pair of the elongate heater strips, a second pressure roller parallel to the first pressure roller and closely spaced with respect thereto, the folded web moving along the first section of the elongate support structure and between the upper heater strips and the lower heater strips for melting the glue which is between the folded parts of the folded web and which is between the pairs of spaced-apart elongate heater strips, the folded web then moving between the closely spaced pressure rollers as the elastomeric pressure rings of the first pressure roller and the second pressure roller apply pressure to the longitudinally extending regions of the folded parts of the web which have traveled between the pairs of heater strips and to the melted glue between the folded parts of the web, the folded web then moving between the thermal conductor plates for cooling the web and for soidifying the glue as the folded web travels between the thermal conductor plates, the support means being movable with respect to the lower heater strips to move the upper heater strips from the lower heater strips to provide access to the portions of the folded web which are positioned between the lower heater strips and the upper heater strips.

2. The apparatus of claim 1 in which each of the lower heater strips and each of the upper heater strips is laterally adjustable to accommodate folded webs of various widths and glue patterns.

3. The apparatus of claim 1 in which the support means is pivotally attached to the elongate support structure.

4. The apparatus of claim 1 in which each of the elastomeric pressure rings is axially adjustable upon the first pressure roller.

* * * * *